US007694619B2

(12) United States Patent
Beretta

(10) Patent No.: US 7,694,619 B2
(45) Date of Patent: Apr. 13, 2010

(54) LOW LETHALITY FIREARM AND RELATIVE METHOD FOR SHOOTING A LOW LETHALITY BULLET

(75) Inventor: Ugo Gussalli Beretta, Gardone Val Trompia (IT)

(73) Assignee: Fabbrica D'Armi Pietro Beretta S.p.A., Gardone Val Trompia Brescia (IT)

( * ) Notice: Subject to any disclaimer, the term of this patent is extended or adjusted under 35 U.S.C. 154(b) by 1090 days.

(21) Appl. No.: 11/183,532

(22) Filed: Jul. 18, 2005

(65) Prior Publication Data

US 2006/0283068 A1 Dec. 21, 2006

(30) Foreign Application Priority Data

Jul. 27, 2004 (IT) ..... MI2004A1520

(51) Int. Cl.
*F41A 21/28* (2006.01)
*F41A 1/06* (2006.01)

(52) U.S. Cl. ..... 89/14.3

(58) Field of Classification Search ..... 89/14.4, 89/14.3; 42/76.01
See application file for complete search history.

(56) References Cited

U.S. PATENT DOCUMENTS 2,397,800 A * 4/1946 McArthur ..... 89/8
2,869,272 A * 1/1959 Coyle ..... 42/79
3,346,981 A * 10/1967 Tabor ..... 42/106
3,380,344 A * 4/1968 Bucklisch et al. ..... 89/14.3
4,126,077 A * 11/1978 Quesnel ..... 89/1.704
5,097,614 A 3/1992 Strong et al.
5,279,200 A * 1/1994 Rose ..... 89/14.3
5,479,736 A 1/1996 Forrester et al.
6,374,720 B1 4/2002 Tedde
6,412,390 B1 * 7/2002 Dindl ..... 89/14.5
2003/0183114 A1 10/2003 Widener

FOREIGN PATENT DOCUMENTS

DE 196 53 784 A1 6/1998
GB 1 350 327 A 4/1974

OTHER PUBLICATIONS

European Search Report, Nov. 7, 2005.

* cited by examiner

*Primary Examiner*—Troy Chambers
(74) *Attorney, Agent, or Firm*—Hedman & Costigan, P.C.; James V. Costigan

(57) ABSTRACT

A low lethality firearm, comprising a launcher (12) for bullets, also comprises a device for regulating the speed of the bullet (13), adapted for varying the speed of the bullet in the mouth of a barrel, comprising gas bleeding means (17, 19) from the inside of a barrel (16) of the launcher (12), wherein these gas bleeding means (17, 19) can be divided.

15 Claims, 6 Drawing Sheets

LOW LETHALITY FIREARM AND RELATIVE METHOD FOR SHOOTING A LOW LETHALITY BULLET

The present invention relates to a low lethality firearm and a relative method for shooting a low lethality bullet.

The field of the so-called "low lethality" arms comprises arms designed for the purpose of causing limited and possibly reversible damage to the human target, which are nonetheless able to cause momentary incapacitation or deter the subject hit from carrying out an illegal or criminal action.

The term "low lethality" has a precise meaning, which will become clearer later on that differs in essence from the term "non lethality". "Low lethality" refers to a characteristic, such that the bodily trauma has a limited percentage of causing permanent damage or death (such percentage depending on the biological parameters of the subject who is hit—age, sex, body size, any pathologies suffered etc. and on the part that is hit), whilst "non lethality" refers to a trauma, which, by nature, is not able to cause irreversible damage.

Various non lethal or low lethality arms, or arm systems, are known today. The method on which the temporarily incapacitating action is based can be an electric discharge (direct or carried onto the target by means of two needles connected to the arm by wires) or, for example, inhalation of an irritant substance carried onto the target by a projectile with very low kinetic energy. These systems usually belong to the non lethality category, since the electric shock or the action of the irritant agent can be "regulated" to ensure, with relative certainty, that permanent damage or death is not caused to the subject, who is hit.

Whereas we can classify as low lethality those arm systems, which base the incapacitating effect, for example on the kinetic action from the impact of the projectile on the target and are affected by the variability of the above mentioned parameters, and not only, which will become clear later on.

It is known that the impact of a mass, in itself, which is relatively flexible or deformable, thrown at a certain speed against a skeletal or muscular structure can cause simple irritation, an intense sensation of pain accompanied by a phase of temporary incapacitation, which renders the subject passive, or causes permanent injury by damaging or penetrating organs, breaking skeletal segments or even death by bleeding due to broken vessels, or cardiac arrhythmias, cerebral lesions etc.

As we said before, the variability of the effect depends on the various biological parameters of the subject hit, on whom, unfortunately, it is obviously impossible to intervene to adapt them to a standard condition.

Moreover, with a kinetic effect low lethality arm system, such variability also depends on the typical parameters of the impacting ammunition, in other words on the shape, size, material and kinetic energy of the projectile.

If it is true and obvious that more plastic materials interact in a "softer" way with the human target, increasing the area of the impact surface, it is also true and obvious that the energy of the impacting projectile is a parameter that is closely related to the damage caused.

This means that if the energy is too low, it can prevent the objective from being reached (incapacitation), whilst if the energy is too high, it can cause permanent damage.

Experience reported in literature offers an indicative figure as regards the energy level that the low lethality projectile must possess; nonetheless, this figure must be optimised to take into consideration the particular characteristics of the projectile itself.

By observing individual arms, based on a kinetic effect, already present on the market, analysing their characteristics and studying the ballistics of the projectiles used, we can consider that the operative distance of engagement of the target is limited to a maximum of 20-25 metres, and that such distance range is the maximum allowed considering the drop in speed, and therefore the energy, of the projectile along its path. Consequently, greater distances are incompatible with said drop in speed, and therefore in energy, if we intend to satisfy the criterion of low lethality, which determines a particular kinetic energy on the target.

It is the object of the present invention to realise a firearm and a method for shooting a low lethality bullet, which overcome the described disadvantages of the known art.

Another object is to realise a firearm and a method for shooting a low lethality bullet based on the kinetic effect of the bullet on the target.

A further object is to realise a low lethality firearm, wherein it is possible to regulate the energy given to the bullet by varying the speed of the projectile in the mouth of the barrel and a relative method for shooting a low lethality bullet.

Another object of the present invention is to realise a low lethality firearm that is particularly simple and practical, with low costs.

According to the present invention, these objects are achieved by realising a low lethality firearm and a relative method for shooting a low lethality bullet as described in the independent claims.

Further characteristics are foreseen in the dependent claims.

The characteristics and advantages of a low lethality firearm and a relative method for shooting a low lethality bullet according to the present invention will be made clearer from the following description, which is given by way of example and not limiting, referring to the appended schematic drawings wherein.

Figure 1:
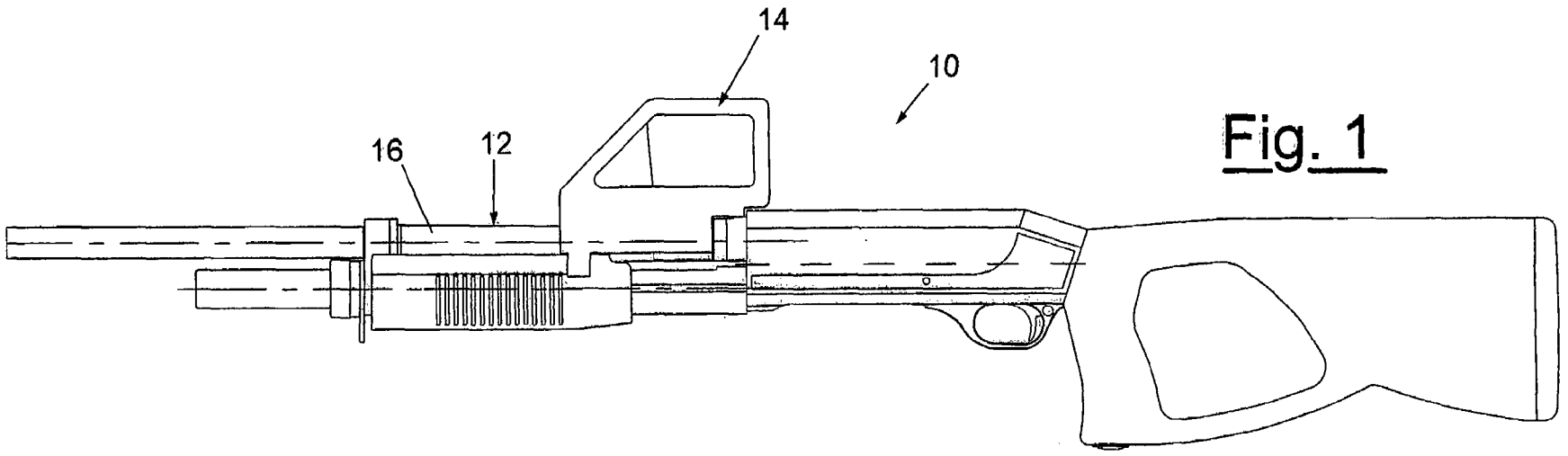
FIGS. 1 and 2 are an elevation and plan view respectively of a low lethality firearm, the object of the present invention.
Figure 2:
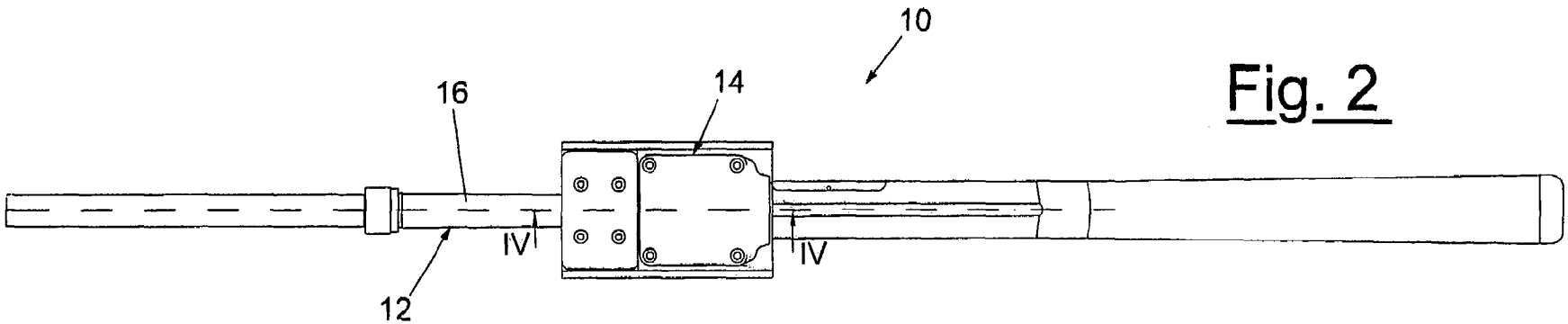

With reference to the figures, a low lethality firearm is shown globally indicated with reference numeral 10 and comprising a launcher 12 for low lethality bullets or projectiles, as well as for traditional, lethal projectiles, a device for regulating the speed of the bullet 13, a device for assessing the distance of the target 14, as well as mechanical connecting means between said regulating device 13 and said assessing device 14.

The launcher 12, shown by way of example in FIG. 1, is a calibre 12 type with a ruled barrel, "pump" type, which is not described in detail, as it is well known to those skilled in the art. However, the application is not necessarily restricted to such type of launcher, because, in the same way, it can integrate well in the structure of a revolver fed gun, semi-automatic, manual, with a fixed or balancing barrel, and a smooth or ruled bore.

Figure 3:
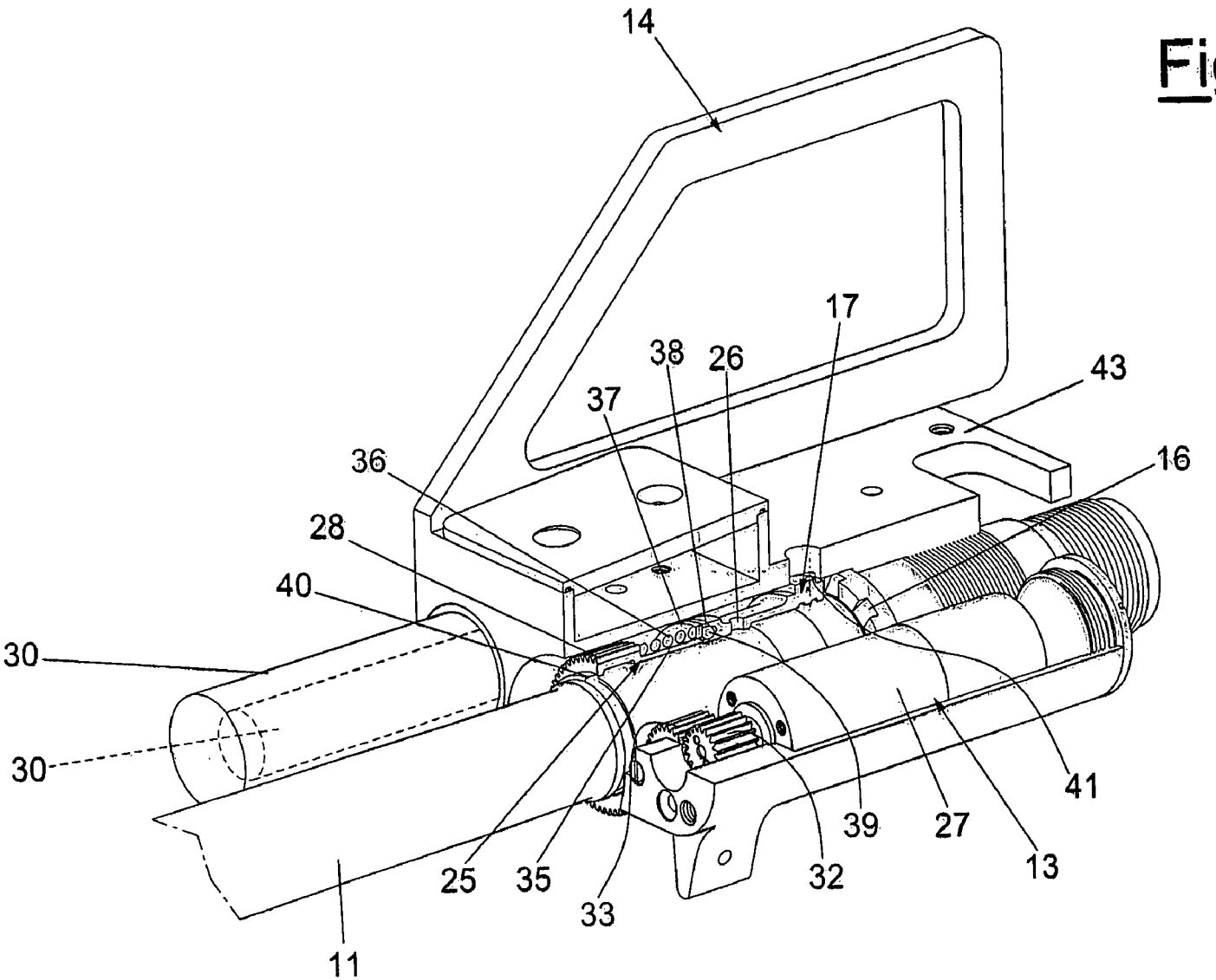
FIG. 3 is a partially split, perspective view of a detail of the arm in FIG. 1.

The device for regulating the speed of the bullet 13, shown in the split detail in FIG. 3, acts by varying the speed of the bullet in the mouth of a barrel 16 to reach different shooting distances with the same impact energy on the target. Under normal shooting conditions, thanks to the explosion of the powder in an explosion chamber, not shown, and to the consequent development of gas, the bullet is accelerated inside the barrel 16 until it reaches its maximum speed.

According to the present invention, the speed in the mouth is varied in the arm 10, in an adjustable manner, to obtain the speeds in the mouth requested depending on the shooting distance and on the impact energy on the target desired. In fact, at an high target distance, the projectile must develop the maximum speed in the mouth to compensate the drop in speed along the path; at a short target distance, the projectile must be given a speed in the mouth, which is low enough to avoid an excessive speed, and consequently excessive impact energy; an intermediate regulation of the speed of the projectile will correspond to intermediate target distances.

From what has been said, it is clear that such integrated system to vary the speed in the mouth according to the distance of the target must preferably be able to measure or, at least, "assess" such distance.

The device for assessing the distance of the target 14 is an optical-mechanical device comprising an optical sight, which is not described in detail, as it is known, based on sighting with variable stadiometric points. The stadiometric lines, which are widely used in sighting devices that serve to assess the distance, exploit the optical triangulation principle to estimate the distance of an object, the human body, of known dimensions. In this case, the optical sight allows two luminous points to be projected with a variable distance, inside the device, to be able to collimate them on the ends of the target sighted. A third luminous point, projected on an intermediate position of the target, indicates the theoretical point of impact. This operation of collimation provides the system with the information relating to the distance at which the target is set.

At the same time, since the luminous points move along the vertical axis according to the distance sighted, the operation of collimation prepares the sighting according to the correct rear sight angle.

Figure 4:
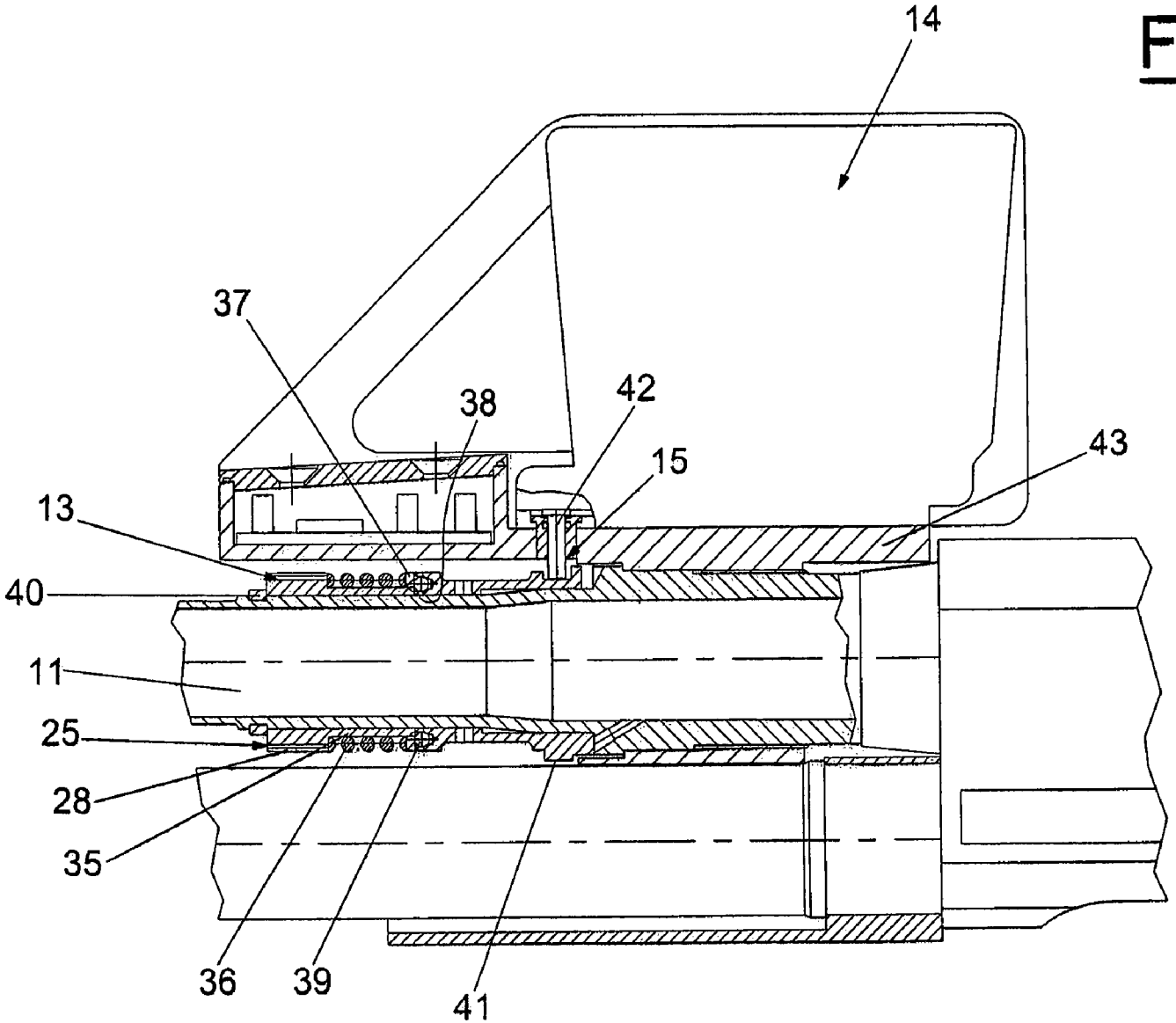
FIG. 4 is a view of the detail in FIG. 3, which is sectioned according to the outline IV-IV in FIG. 2.

The device for regulating the speed of the bullet 13 and the device for assessing the distance of the target 14 are connected by means of the mechanical connecting means, shown schematically in section in FIG. 4 and discussed in detail later on, and they ensure the correct correlation between the speed in the mouth and the estimated distance.

Figure 6:
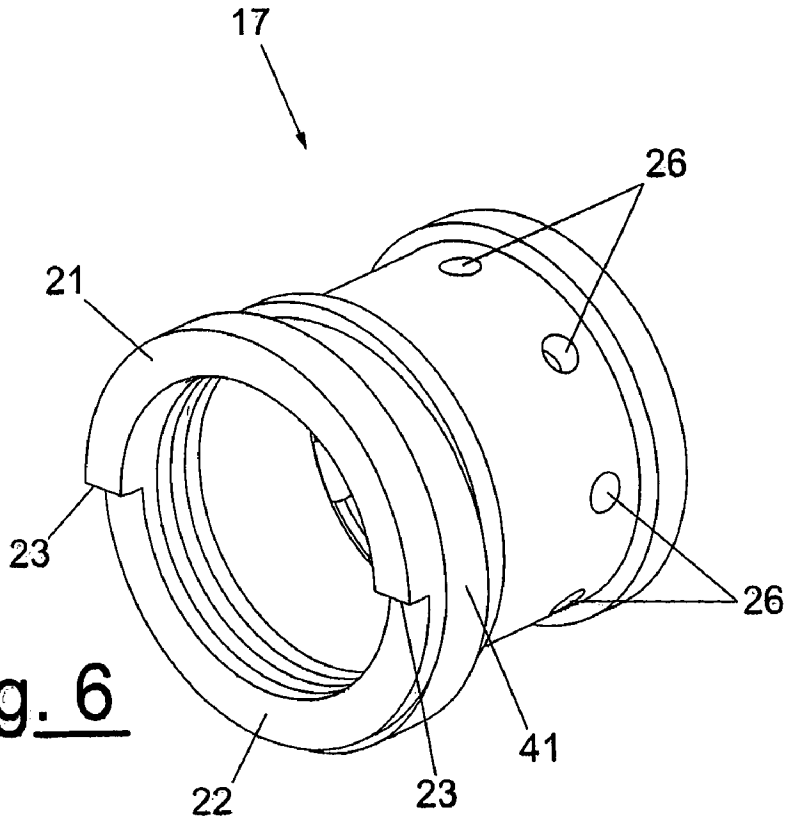
FIGS. 5 and 6 are enlarged, perspective views of a bleed valve of the low lethality arm, the object of the present invention.
Figure 5:
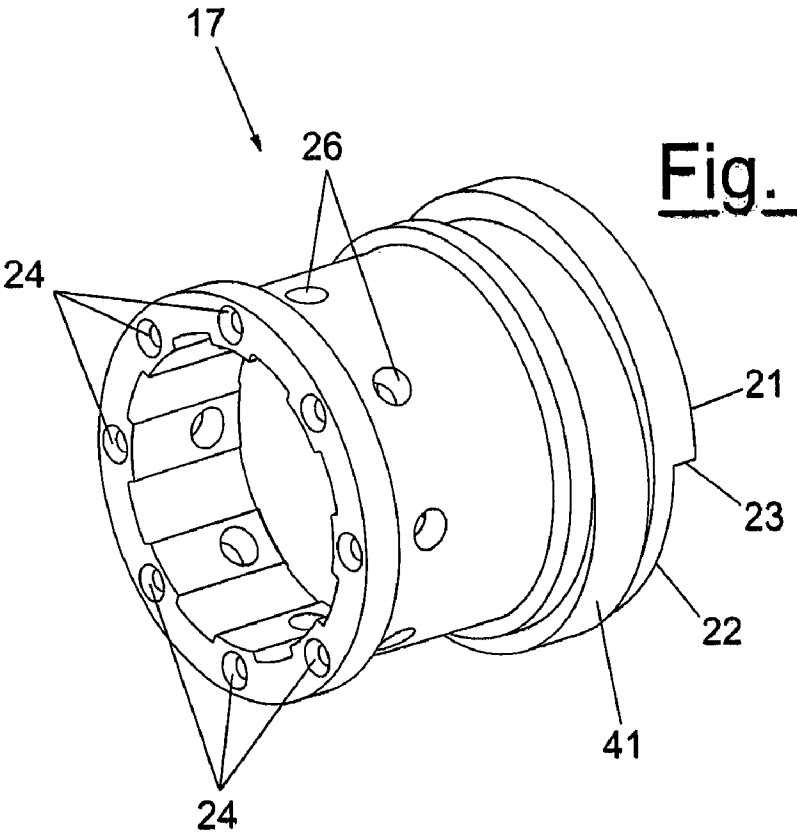
Figure 7:
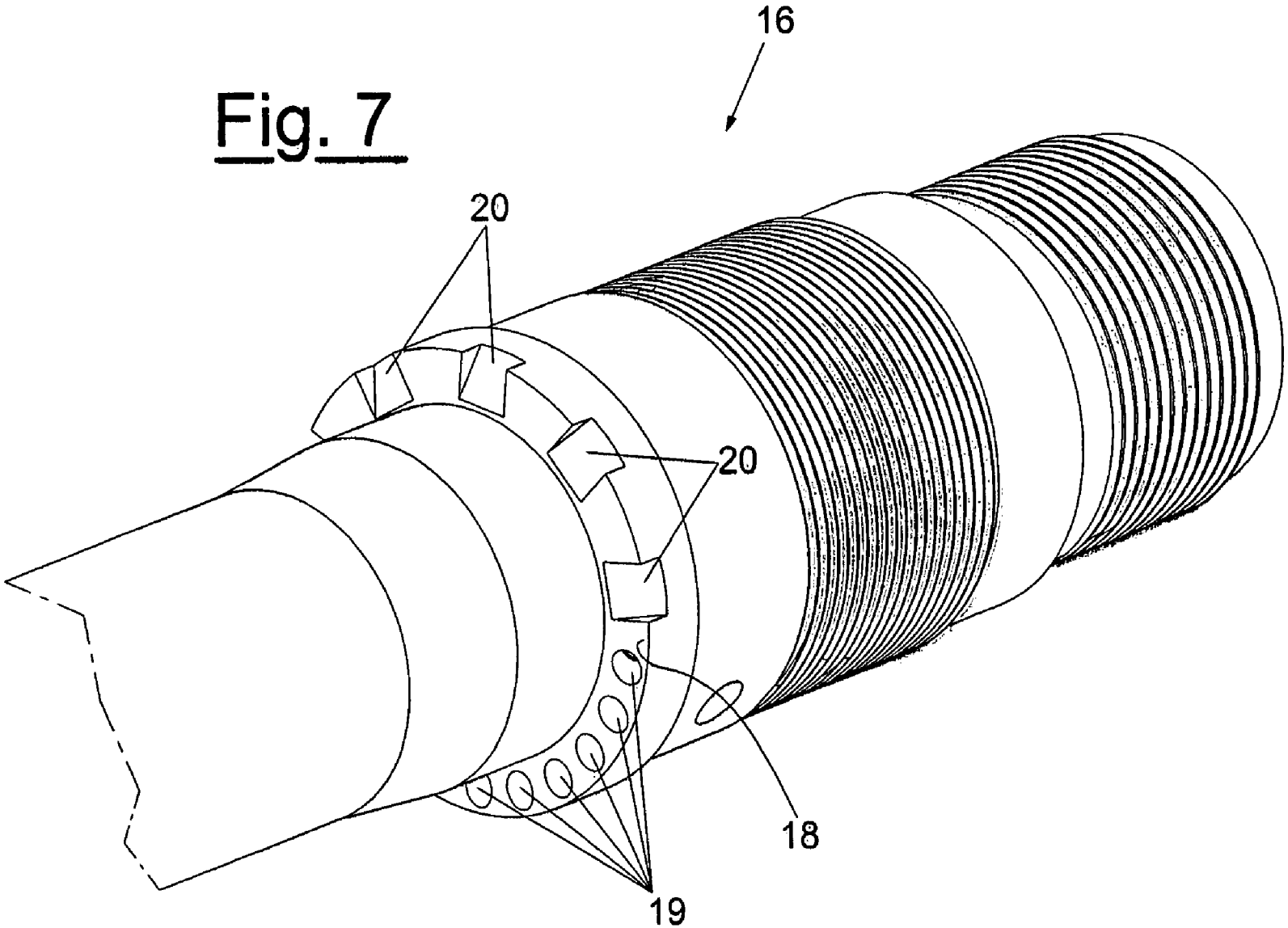
FIG. 7 is an enlarged, perspective view of a detail of the barrel of the arm, the object of the present invention in a bleeding zone.

The device for regulating the speed of the projectile 13 comprises a valve 17, shown in detail in the enlarged perspective views in FIGS. 5 and 6, which is located on the barrel 16 of the launcher near the explosion chamber.

The valve 17 performs a removal, or bleeding of gas and can be regulated to allow different partializations of the thrust of the gases to realise the various speeds requested in the mouth: the valve closed will correspond to the maximum distance possible; the valve open will reduce the speed and impact energy of the bullet on targets at a lower distance.

Figure 8:
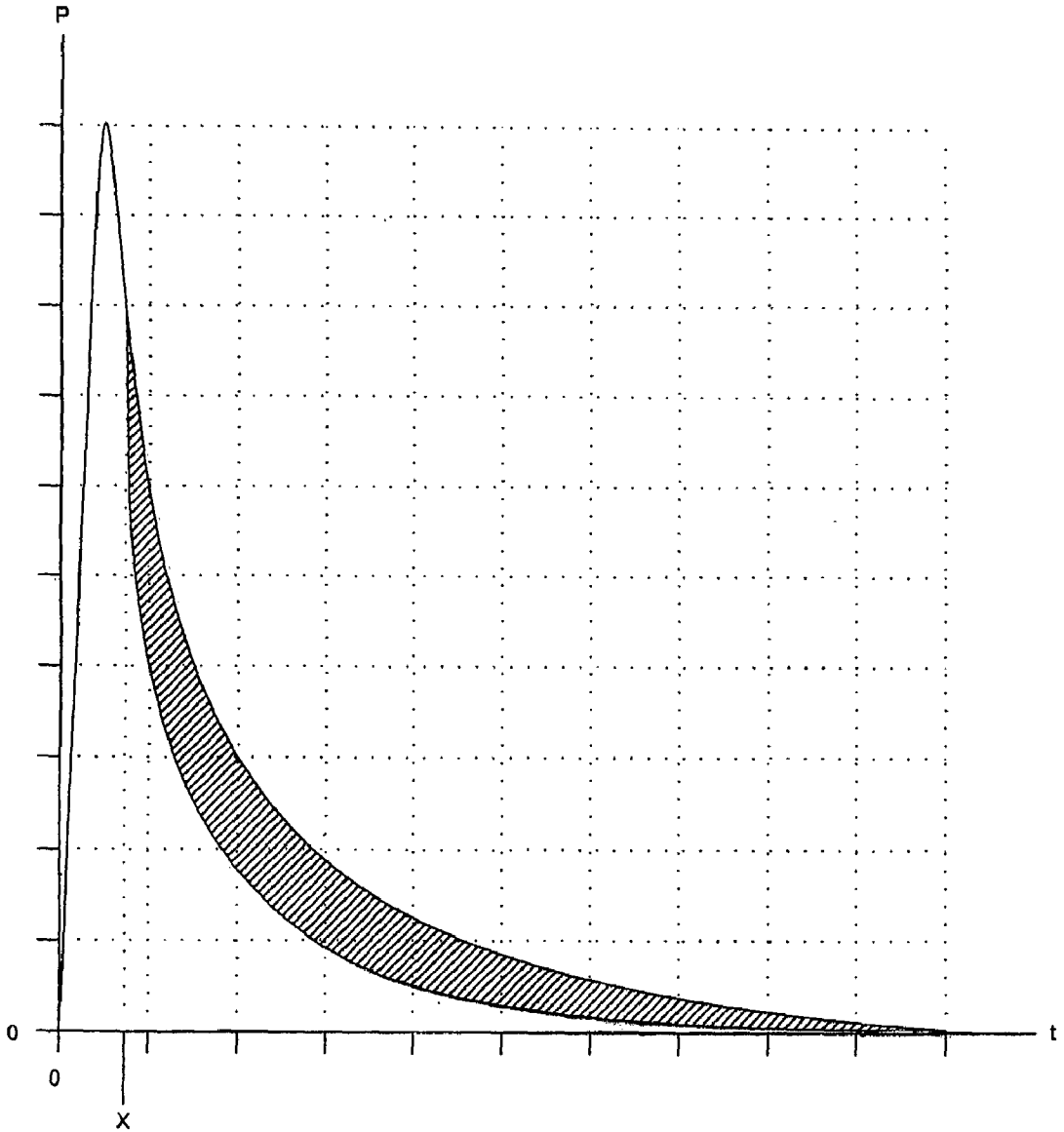
FIG. 8 shows a schematic diagram of the state of the pressure in time after a shot.

The schematic diagram in FIG. 8 shows the progress, in time, in a continuous line, of the pressure inside the barrel after a shot in the explosion chamber at the temporal instant of zero. After a peak, the pressure in the barrel drops until it is cancelled out, when the bullet leaves the mouth of the barrel. The bleeding, which is realised in a section of the barrel downstream of the explosion chamber, therefore occurs in a temporal instant X, shown in the diagram, in which the pressure is closer to the peak value, the nearer the bleeding section is to the explosion chamber.

In the diagram, the outlined area indicates the impulse cut after the reduction in pressure as a result of the bleeding of gas through the valve. In relation to what is described, the bleeding will be more effective, if the bleeding section in the barrel is realised as close as possible to the explosion chamber or even level with it.

In a preferred embodiment according to the present invention, on the barrel 16, in a section that is suitably drawn back to guarantee an adequate cutting of the impulse generated by the gases on the bullet, a flat surface 18, or bleeding surface is realised towards the muzzle side of the barrel, on which a variety of through holes 19 are realised for bleeding the gas, of a suitable number and size to guarantee the bleeding needed for the minimum shooting distance. A plurality of bas-relief exhausts 20 with a sharp profile are also realised on this flat surface 18 for cleaning the valve 17. The valve 17 comprises an substantially cylindrical body that can rotate continuously around the barrel 16 clockwise or anti-clockwise, in other words without mechanical stops. The valve 17 also realises precise coupling on the surface of the barrel 16, which is chromium-plated to eliminate problems of oxidation.

On one side of contact with the barrel 16, there is a closing surface 21 that serves to close, by means of rotation, one or more holes of the barrel, as well as a lowered surface 22, near which the holes 19 that are not closed can let the gas flow. This lowered surface 22 is realised with two sharp sides 23, which, during the rotation of the valve 17, serve to clean the unburnt gas deposits, which may deposit on the bleeding surface 18 of the barrel.

On an opposite side, the valve 17 carries a plurality of frusto-conical shaped seats 24 for coupling with a torque limiter safety joint 25.

On the body of the valve 17, and in particular on one cylindrical side surface thereof, holes 26 are also provided that can be activated from the outside, for example with a punch to unblock the valve 17, if this were completely blocked, for example after the arm had been put back without the necessary cleaning and not used for a long period of time.

In addition to the valve 17 and the torque limiter safety joint 25, the device for regulating the speed of the bullet 13 also comprises a command motor 27 with relative gearing, as well as one or more packs of batteries 29 to supply the motor 27.

In fact, the transmission of the movement to the valve 17 is guaranteed by the electric micro motor 27, which is supplied by the batteries 29 and controlled by an electronic board, not shown. The electric micro motor 27, coupled with an epicycloidal micro reducer with several phases, is characterised by its reduced size and the high transmission torque, as well as by the contained weight, as an important factor in an individual arm.

The use of batteries 29, for example lithium batteries, provides the arm system with sufficient autonomy, also with a reduced number of batteries compared with traditional alkaline batteries, and consequently with a reduced weight. Nonetheless it is foreseen to increase the autonomy of the arm system by adding a supplementary pack of batteries with an extension plug 30, shown in FIG. 3.

A toothed pinion 32 is mounted onto a pivot of the electric micro motor 27, which transmits the movement to a cylindrical body 35 of the joint carrying a toothed portion 28, by means of an idler gear 33 keyed onto a fixed pin.

The body 35 of the joint rotates around the barrel 16 by means of precise coupling realised on the cylindrical surface of the barrel 16, which is chromium-plated to eliminate problems of oxidation with the coupling.

An axial spring 36 is mounted around the body 35 of the joint wrapped between the toothed portion 28 of the joint 25 and an annular disk 37, which both rotate around the barrel 16. Consequently, the spring 36 only transmits the axial component, not generating resistance to the rotation caused by friction, achieving a dual function. The main function, for which the work force of the spring 36 itself was calculated, is to allow the working of the torque limiter safety joint 25. The second function is to keep the valve 17 pressed on the bleeding surface 18 of the barrel 16 to ensure that the deposits of unburnt gases are cleaned during the rotation. Moreover, since the contact surface between the barrel 16 and the valve 17 is flat, and since the latter is energized by the spring 36, a perfect seal of the gases is guaranteed, when the valve 17 is closed. In fact, this type of seal is not influenced by the errors typical of cylindrical seals and is easy to realise.

By means of front toothing, the body 35 of the joint transmits the movement to a ball cage 38, which has a plurality of seats for balls 39.

The balls 39, which are guided into the appropriate seats, are pushed by the spring through the disk 37 into the frusto-conical shaped seats 24 realised on the valve 17.

The angle of the frusto-conical shaped seats 24 and the force of the spring 36 are proportionate to guarantee a sliding torque of the safety joint 25, which prevents the electric micro motor 27 from overloading.

Advantageously, the torque limiter safety joint 25 also provides to unblock the valve 17 without needing to act from the outside. In fact, when the balls 39 come out of the seats 24 onto the valve 17, they cause the joint 25 to slide for an angle of rotation equal to the corresponding angle between successive balls 39. During the rotation corresponding to this angle, the motor 27 accelerates from a lock position to the maximum speed it can reach. When the ball 39 enters the following frusto-conical shaped seat 24 it produces a knock. A series of knocks produces a small rotation of the valve 17, which unblocks the valve itself.

The set composed of the body 35 of the joint, the ball cage 38 and the valve 17, complete with the spring 36, disk 37 and balls 39, is constrained axially to the barrel 16 with zero play by means of an assembly ring 40, for example a Seeger ring. The assembly with zero play ensures a perfect seal of the closing surface 21 of the valve 17 on the bleeding surface 18 of the barrel 16, even in the event of the spring 36 being unable to overcome the pressure of the gases.

The mechanical connecting means between the device for regulating the speed of a bullet 13, described, and the device for assessing the distance of the target 14 comprise an eccentric cam 41 realised on the body of the valve 17, which transmits a vertical movement, by means of contact, to a feeler, or cam follower, 42 by rotation, to command the optical system 14. The moving of the control feeler 42 allows the moving function of the luminous points of stadiometric collimation that was briefly described previously by means of a known system.

Since the cam 41 is set on an arc of 360°, the sighting is possible from a minimum distance to a maximum distance and vice versa, by rotating the valve 17 continuously in one single direction. Nonetheless, the sighting can also be corrected by rotating in the opposite direction.

The device for assessing the distance of the target 14 is mounted onto the barrel 16 through a support box 43 of the electric micro motor 27 and batteries 29 and is therefore not affected by positioning errors caused by the connection between the barrel and the frame. Moreover, the field disassembly of the barrel is always possible from the frame without problems of connection or phase.

In any case, it is always possible to regulate the rear sight and bypass on installation for correct alignment of the barrel with the optical device.

By means of a lamina contact set on the surface of the box 43 the supply, for example, is transmitted (with the possibility of regulating the luminosity) to the led in the optical device 14. The contact is isolated with an o-ring washer.

The method for shooting a low lethality bullet in a firearm comprises the steps of arming the firearm with a low lethality bullet, triggering the explosion in the explosion chamber, bleeding a predetermined quantity of gas from a portion of the barrel to reduce the energy of the bullet by a desired amount, in other words its speed in the mouth of the barrel, in order to obtain an impact with constant and foreseeable energy on a target at a variable distance.

In a preferred embodiment of the present invention, the distance of the target is assessed before each shot by a collimation step of the target synchronised with the bleeding step.

The low lethality firearm, the object of the present invention, has the advantage of correlating the energy of the bullet with the estimated distance of the target in a simple and reliable way.

In fact, it is possible to obtain the same bleeding calibration by rotating both clockwise and anti-clockwise, since the correlation between the quantity of gas bled and the assessment of the distance of the target is biunique.

Moreover, the mechanical connection between the device for regulating the speed and the device for assessing the distance of the target enables the phase to be maintained constantly, also after the optical device of the barrel has been disassembled, as well as reduced operating friction. Finally, advantageously, it also avoids all calibration and phase problems of any electronic connection.

The arm, the object of the present invention, is also advantageously able to shoot standard ammunition, in other words lethal ammunition. Moreover, the exhaustion of the battery charge does not prevent the arm from shooting and consequently guaranteeing personal protection.

The arm, the object of the present invention, advantageously exhibits high component integration, all constrained to the barrel. Advantageously, electrical and mechanical kickbacks are avoided.

Moreover, according to the present invention, the regulating device valve favours the cleaning of the flat contact surfaces, as well as the removal of dirt.

Advantageously, such valve can also be unblocked, for example when the arm has not been used for long periods of time by the action of the ball safety joint, which transmits a series of shots to the valve sliding into the locked valve position.

This thus designed low lethality firearm is subject to diverse modifications and variations, all included in the invention; moreover, all of the details can be replaced by technically equivalent elements. Basically, any materials and sizes can be used depending on the technical needs.

The invention claimed is:

1. A low lethality firearm comprising a launcher (12) for bullets, wherein the firearm comprises a device for regulating the speed of the bullet (13) and adapted for varying the speed of the bullet in the mouth of a barrel (16), said device for regulating the speed (13) comprising gas bleeding means (17, 19) for bleeding gas from the inside of said barrel (16) of said launcher (12), wherein said gas bleeding means (17, 19) can be divided, wherein said bleeding means comprise a bleeding surface (18) on said barrel (16) provided with a plurality of through holes (19) in said barrel (16) for bleeding gas from the inside of said barrel (16), wherein said bleeding surface (18) is coupled to a valve (17) mounted onto said barrel (16) wherein said valve (17) can be rotated continuously around the barrel and wherein said valve (17) comprises a closing surface (21) and a lowered surface (22), at the same end, wherein said valve (17) is adapted for closing or opening said holes (19).

2. The firearm according to claim 1, wherein said bleeding surface (18) is realised in a portion of said barrel (16) immediately downstream, or level with an explosion chamber.

3. The firearm according to claim 1, wherein said lowered surface (22) is realised with two sides (23) adapted for cleaning the deposits of unburnt gases from said bleeding surface (18) of said barrel (16) during the rotation of said valve (17).

4. The firearm according to claim 1, wherein said valve (17) comprises a plurality of holes (26) on one cylindrical side surface thereof that can be operated from the outside to unblock said valve (17).

5. A low lethality firearm comprising a launcher (12) for bullets, wherein the firearm comprises a device for regulating the speed of the bullet (13) and adapted for varying the speed of the bullet in the mouth of a barrel (16), said device for regulating the speed (13) comprising gas bleeding means (17, 19) for bleeding gas from the inside of said barrel (16) of said launcher (12), wherein said gas bleeding means (17, 19) can be divided, wherein said bleeding means comprise a bleeding surface (18) on said barrel (16) provided with a plurality of through holes (19) for bleeding gas from the inside of said barrel (16), wherein said bleeding surface (18) is coupled to a valve (17) mounted onto said barrel (16) and that can be rotated continuously around the barrel wherein said device for regulating the speed of the bullet (13) comprises an electric control motor (27), gear drive (28, 32, 33, 35) and a torque limiter safety joint (25).

6. The firearm according to claim 5, wherein said drive comprises a toothed pinion (32) mounted onto a shaft of said motor (27) engaged with an idler gear (33) keyed onto a fixed pin and engaged with a toothed portion (28) of said safety joint (25).

7. The firearm according to claim 5, wherein said safety joint (25) is a ball joint.

8. The firearm according to claim 5, wherein said safety joint (25) comprises a cylindrical body (35) applied onto said barrel (16) that can be rotated around it, said body (35) carrying said toothed portion (28).

9. The firearm according to claim 8, wherein said safety joint (25) comprises an axial spring (36) set around said cylindrical body (35) and adapted for guaranteeing a seal between said valve (17) and said bleeding surface (18) of said barrel (16), as well as fin limiting the torque transferred by said joint (25).

10. The firearm according to claim 9, wherein said spring (36) is wrapped between said toothed portion (28) and an annular disk (37) next to a ball cage (38) that is integral with said body (35) of the joint (25).

11. The firearm according to claim 5, wherein said valve (17) has a plurality of frusto-conical shaped seats (24) on a second end surface for coupling to said safety joint (25).

12. A low lethality firearm comprising a launcher (12) for bullets, wherein the firearm comprises a device for regulating the speed of the bullet (13) and adapted for varying the speed of the bullet in the mouth of a barrel (16), said device for regulating the speed (13) comprising gas bleeding means (17, 19) for bleeding gas from the inside of said barrel (16) of said launcher (12), wherein said gas bleeding means (17, 19) can be divided, wherein said bleeding means comprise a bleeding surface (18) on said barrel (16) provided with a plurality of through holes (19) for bleeding gas from the inside of said barrel (16), wherein said bleeding surface (18) is coupled to a valve (17) mounted onto said barrel (16) and that can be rotated continuously around the barrel said arm comprises an optical-mechanical device for assessing the distance of the target (14) and mechanical connecting means between said device far regulating the speed of the bullet (13) and said device for assessing the distance of the target (14).

13. The firearm according to claim 12, wherein said arm comprises at least one pack of batteries (29) for supplying said device for regulating the speed of the bullet (13) and said device for assessing the distance of the target (14).

14. The firearm according to claim 12, wherein said mechanical connecting means comprise an eccentric cam (41) set on said bleeding means (17) that is coupled to a feeler element (42), which is adapted for moving in a vertical direction to control the device for assessing the distance of the target (14).

15. The firearm according to claim 12, wherein said device for assessing the distance of the target (14) is mounted onto said barrel (16) by means of a support box (43) of said device for regulating the speed of the bullet (13).

* * * * *